United States Patent [19]

Hebert

[11] 4,051,941

[45] Oct. 4, 1977

[54] MATRIX PRINT HEAD WITH IMPROVED ARMATURE RETAINER

[75] Inventor: Donald G. Hebert, San Ramon, Calif.

[73] Assignee: Xerox Corporation, Stamford, Conn.

[21] Appl. No.: 700,417

[22] Filed: June 28, 1976

[51] Int. Cl.[2] ..... B41J 3/50

[52] U.S. Cl. ..... 197/1 R; 101/93.05

[58] Field of Search ..... 197/1 R; 101/93.04, 101/93.05

[56] References Cited

U.S. PATENT DOCUMENTS

| | | | |
|---|---|---|---|
| 3,333,667 | 8/1967 | Nordin | 197/1 R |
| 3,828,908 | 8/1974 | Schneider | 197/1 R |
| 3,842,955 | 10/1974 | Iwasaki | 197/1 R |
| 3,854,564 | 12/1974 | Flaceliere et al. | 197/1 R |
| 3,896,918 | 7/1975 | Schneider | 197/1 R |
| 3,929,214 | 12/1975 | Hebert | 197/1 R |
| 3,994,381 | 11/1976 | Hebert | 197/1 R |

*Primary Examiner*—Ralph T. Rader

*Attorney, Agent, or Firm*—M. J. Colitz; T. J. Anderson; B. P. Smith

[57] ABSTRACT

A matrix print head comprises stylus guide means; a plurality of electromagnetic structures coupled to the guide means, each of the electromagnetic structures including a pole piece; a plurality of armatures disposed radially about the guide means, each of the armatures being associated with one of the electromagnetic structures to form an electromagnetic actuator for transferring electromechanical energy to a stylus, and each of the armatures having an inner end and an outer end projecting outwardly of the associated pole piece; a plurality of styli respectively associated with the plurality of armatures, each stylus being carried by the guide means and having an armature engaging end for engaging the inner end of the associated armature and a printing end for impacting a record medium when the stylus is propelled through the guide means by energization of the associated electromagnetic actuator; and an improved armature retainer coupled to the guide means for maintaining each armature in engagement with its associated pole piece. The armature retainer comprises a relatively rigid base member having a central portion connected to the guide means and a peripheral portion including means for receiving each armature at a predetermined location between its inner and outer ends; and a relatively resilient biasing member mounted to the peripheral portion of the base member for engaging the outer end of each armature in order to bias each armature into engagement with its associated pole piece.

7 Claims, 9 Drawing Figures

MATRIX PRINT HEAD WITH IMPROVED ARMATURE RETAINER

BACKGROUND OF THE INVENTION

The present invention relates to matrix print heads and, more particularly, to an improved ballistics-type matrix print head.

Ballistic-type matrix print heads generally comprise a stylus guide assembly, a plurality of electromagnetic structures coupled to the guide assembly, each structure including an inner pole piece, an outer pole piece and a coil wrapped around the inner pole piece. A plurality of armatures are disposed radially about the guide assembly. Each armature is associated with one of the electromagnetic structures to form an electromagnetic actuator for transferring electromechanical energy to a stylus. Each of the armatures as an inner end and an outer end projecting outwardly of the associated outer pole piece. A plurality of styli are respectively associated with the plurality of armatures, each stylus being carried by the guide assembly and having an armature engaging end for engaging the inner end of the associated armature and a printing end for impacting a record medium when the stylus is propelled through the guide assembly by energization of the associated electromagnetic actuator.

Ballistics-type matrix print heads also usually include one or more armature retainers coupled to the guide assembly for retaining each armature in engagement with its associated outer pole piece. One known ballistics-type matrix print head uses an armature retainer comprised of a single unitary connector having a central portion connected to the guide assembly and a plurality of resilient arms extending axially outward from the central portion. Each of the arms engages the outer end of one of the plurality of armatures for biasing the armature into engagement with the associated outer pole piece, while at the same time applying a moment of force to the armature tending to cause the inner end thereof to rotate about the outer pole piece toward the central portion of the connector.

It is necessary to maintain engagement between the armature and its associated outer pole piece in order to maintain an appropriate magnetic path for the associated electromagnetic actuator. Further, it is desirable to bias the inner ends of the armatures upwardly toward the center portion of the connector for contact with a shock absorbing member mounted therein. Such biasing is thereby intended to effect a simultaneous mutual alignment of the armatures' inner ends so that all actuated sytli will strike a record medium at substantially the same instant of time.

The unitary connector type of armature retainer described above has led to some disadvantages and problems. For one, the biasing force tending to hold each armature engaged with its associated outer pole piece and to rotate the armature inner end upwardly relative to such outer pole piece is applied on an individual basis by the associated resilient arm of the unitary connector. Thus, since there is the possibility of distortion in some arms and general non-uniformity of structure and design among the arms as a whole due to the fabrication process, it will be apparent that there may be corresponding non-uniformity of armature travel. Such non-uniformity may, of course, result in some of the actuated styli striking the record medium at different instants of time.

Another problem with the unitary connector type of armature retainer results from the resilient nature and use of plural individual arms. It has been found that these arms tend to break off by persons either assembling the head, mounting it into a matrix printer unit, or operating such printer. More specifically, since the arms are independently movable relative to one another, they can be inadvertently bent and broken off. This is especially true when considering the fact that the armature outer ends extend outwardly of the head as a whole. They can thus get caught and moved upwardly, thereby causing the associated arm to be bent upwardly and thereby either distorted or broken.

It would be desirable, therefore, to provide a ballistics matrix print head having an improved armature retainer which is substantially free of the above-mentioned disadvantages and problems.

SUMMARY OF THE INVENTION

In accordance with the present invention, an improved armature retainer is provided for a matrix print head of the type comprising stylus guide means; a plurality of electromagnetic structures coupled to the guide means, each of the electromagnetic structures including a pole piece; a plurality of armatures disposed radially about the guide means, each of the armatures being associated with one of the electromagnetic structures to form an electromagnetic actuator for transferring electromechanical energy to a stylus, and each of the armatures having an inner end and an outer end projecting outwardly of the associated pole piece; and a plurality of styli respectively associated with the plurality of armatures, each stylus being carried by the guide means and having an armature engaging end for engaging the inner end of the associated armature and a printing end for impacting a record medium when the stylus is propelled through the guide means by energization of the associated electromagnetic actuator.

The improved armature retainer is coupled to the guide means for maintaining each armature in engagement with its associated pole piece and comprises a relatively rigid base member having a central portion connected to the guide means and a peripheral portion including means for receiving each armature at a predetermined location between its inner and outer ends; anda relatively resilient biasing member mounted to the peripheral portion of the base member for engaging the outer end of each armature in order to bias each armature into engagement with its associated pole piece. Additionally, and preferably, the biasing member also applies a moment of force to each armature tending to cause the inner end of each armature to rotate about its associated pole piece toward the central portion of the relatively rigid base member.

As thus defined, the base member for receiving the armatures is now relatively rigid and, in accordance with the preferred embodiment, is desirably a relatively rigid disc. The necessary biasing forces are applied to the armatures' outer ends by a resilient biasing member, which is preferably a rubber O-ring, mounted to a peripheral portion of the relatively rigid disc. By using a relatively rigid base member to receive the armatures with a separate relatively resilient member to apply the desired biasing force to the armatures' outer ends, the problem of non-uniformity of printing due to distortions in individual resilient arms is substantially eliminated, as is the problem of bending or fracture of such arms. In the preferred embodiment, where the relatively rigid member is unitary disc, there are no arms at all.

These and other aspects and advantages of the present invention will be more completely described below with reference to the accompanying drawings.

DESCRIPTION OF THE PREFERRED EMBODIMENT

Figure 1:
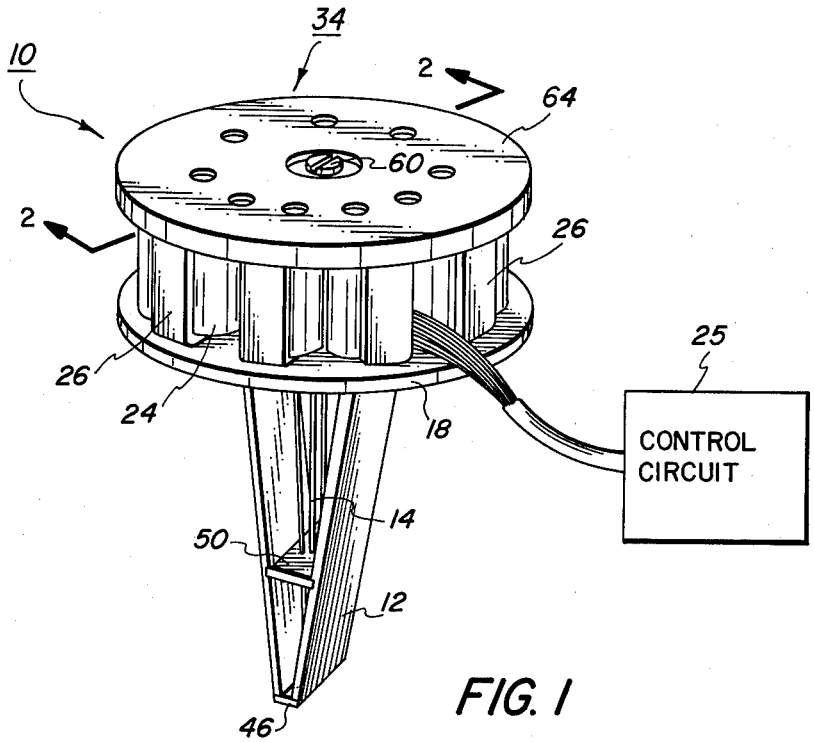
FIG. 1 is a perspective view of a matrix print head of the present invention.
Figure 3:
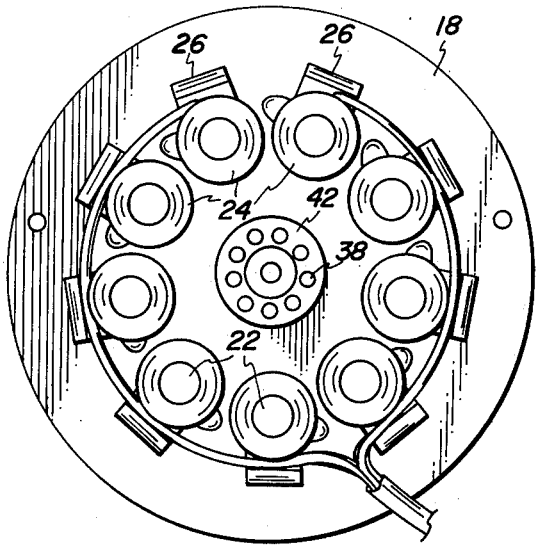
FIG. 3 is a top plan view of the matrix print head of FIGS. 1 and 2 with the armature retainer and armatures deleted for clarity of the remaining components.
Figure 2:
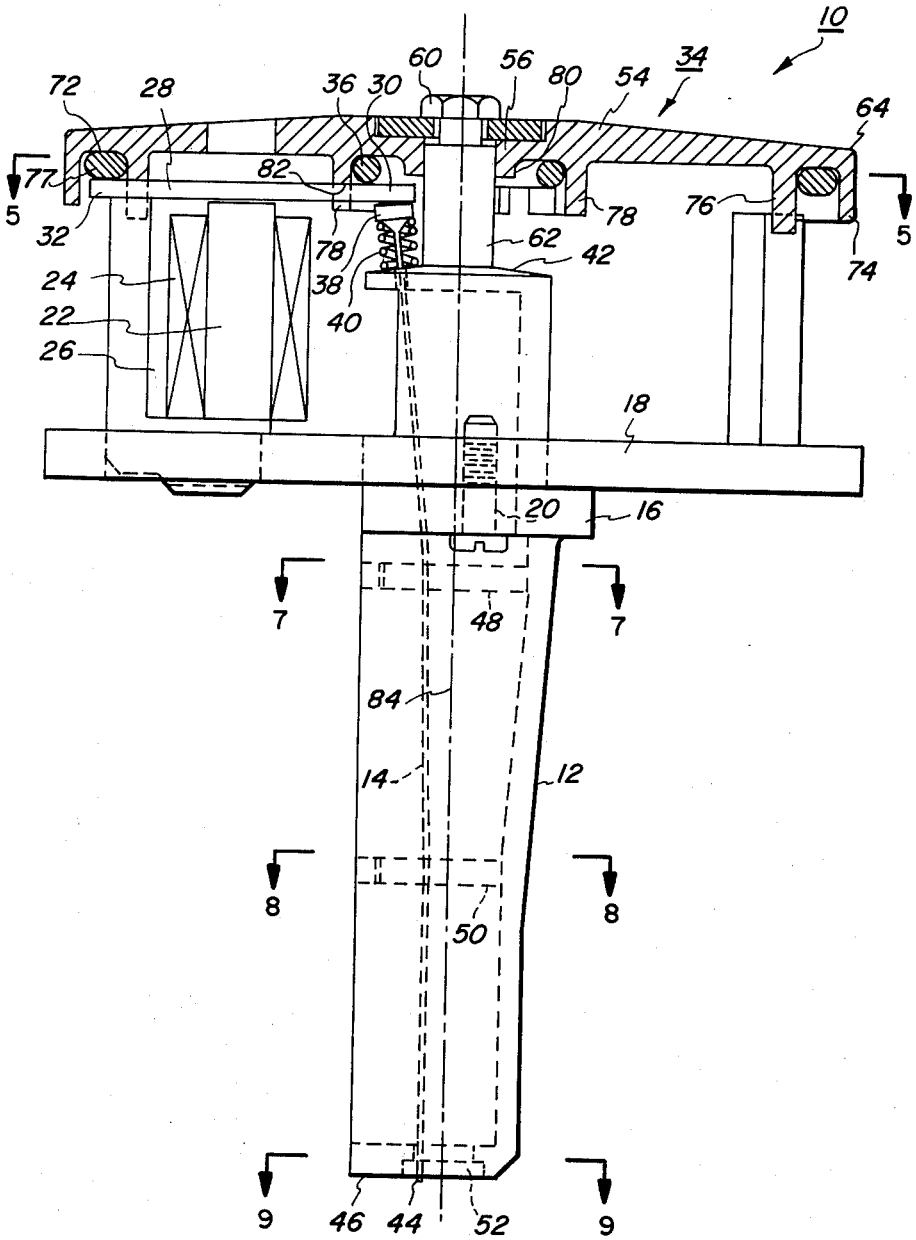
FIG. 2 is a cross-sectional view of the matrix print head of FIG. 1, taken along lines 2 — 2 of FIG. 1.

Referring to FIGS. 1 and 2, a matrix print head 10 is shown comprising a stylus guide assembly 12 for guiding a plurality (e.g. nine) of impact wires or styli 14 along predefined paths to be described in more detail below. The guide assembly 12 includes a base plate 16 to which a support plate 18 is affixed by suitable means, such as a pair of screws 20 (only one shown). A plurality (e.g. nine) of electromagnetic structures are defined on the support plate 18. Each electromagnetic structure includes an inner pole piece 22 upstanding from the top surface of the support plate 18 and a coil 24 disposed about the inner pole piece 22. Each coil 24 is electrically connected to a control circuit 25 for selectively applying a predetermined current flow through the coil for a purpose to be described below. Each electromagnetic structure also comprises an outer pole piece 26 also upstanding from the top surface of the support plate 18 at a location adjacent the associated coil 24, as shown best in FIGS. 2 and 3.

The head 10 also comprises a plurality (e.g. nine) armatures 28 respectively associated with the plurality of elecromagnetic structures. Each armature 28 forms with its associated electromagnetic structure an electromagnetic actuator for transferring electromechanical energy to an associated one of the styli 14. More specifically, and as best shown in FIG. 2, each armature 28 has an inner end 30 and an outer end 32 extending outwardly a predetermined distance from the outer pole piece 26.

With each actuator in a de-energized state, as shown in FIG. 2, the armature 28 thereof is held in contact with the outer-most edge of the outer pole piece 26 at a location on the armature adjacent its outer end 32. An intermediate portion of the armature 28 is spaced a predetermined distance above the inner pole piece 22. The inner end 30 of the armature 28 is biased into contact at its upper surface with a shock absorbing member 36 included in an armature retainer 34 to be described in more detail below. An upper end of each stylus 14 is mounted to a cap 38. A suitable compression spring 40 is coupled between the cap 38 and an upper surface 42 of the guide assembly 12 in order to normally force the cap 38 into engagement with the lower surface of the associated armature 28 adjacent its inner end.

The pole pieces 22 and 26, as well as the armatures 28, are all fabricated of a magnetically permeable material. In this manner, when current is applied through each coil 24, a magnetic path is established causing the associated armature to be attracted to the inner pole piece 22. When this occurs, the armature inner end 30 forces the cap 38 downwardly overcoming the biasing force of the spring 40 and causing the stylus 14 to be propelled downwardly until a printing end 44 of the stylus impacts a record medium (not shown) located adjacent a bottom surface 46 of the guide assembly.

As best shown in FIGS. 3 and 7 - 9 taken together, each stylus 14 follows a generally curvilinear path as it is guided through the guide assembly 12. The guide assembly is so designed such that the upper ends of the styli 14, as mounted in the caps 38, are arranged in a circular array, whereas the lower printing ends 44 are arranged in a substantially linear array. This is made possible by providing a plurality of guide members 48, 50 and 52 which are respectively shown in FIGS. 7 - 9. The hole patterns in these guide members progressively constrict the circular array down to a linear array, as shown. The guide member 52 desirably includes a conventional ruby bearing plate of the variety commonly employed in matrix print heads of this type.

Referring now to FIGS. 1, 2, 4 and 5, the armature retainer 34 will be described in more detail. Generally speaking, the armature retainer 34 has the primary function of maintaining the armature 28 engaged with their associated outer pole pieces 26. Additionally, and preferably, the armature retainer also has the function of applying a moment of force to each armature tending to cause the inner end 30 thereof to rotate about its associated outer pole piece 26 in order to normally hold the armature inner end in engagement with the shock absorbing member 36.

Now then, the armature retainer 34 of the present invention comprises a relatively rigid base member, such as a relatively rigid disk 54, having a central portion 56 connected to the guide assembly 12. More specifically, the disk 54 has a central opening for receiving a screw 60 capable of being screwed into a cylindrical post 62 on the guide assembly 12 upstanding from the upper surface 42 thereof. The disk 54 also includes a peripheral portion 64 including means, such as depending posts 66, for receiving each armature at a predetermined location between its inner and outer ends. More specifically, each armatue 28 has a pair of notches 68 and 70 for respectively engaging the ends of two adjacent posts 66 thereby restraining the radial movements of the armature relatively to the disk 54.

The armature retainer 34 also comprises a relatively resilient biasing member, such as a rubber O-ring 72, mounted to the peripheral portion 64 of the disk between two adjacent circumferential walls 74 and 76. The posts 66 depends from the wall 76. The cross-sectional diameter of the O-ring 72 is such as to normally compress in the manner shown in FIG. 2 when the retainer 34 is mounted to the guide assembly 12 with the actuators de-energized. The axial diameter of the O-ring 72 and those of the walls 74 and 76 are carefully predetermined relative to the location of the armatures 28 and outer pole pieces 26. More specifically, and with reference to FIGS. 2 and 5, the axis 77 of the O-ring is preferably slightly offset outwardly of the pivot line of each armature 28. It will be noted that this pivot line is defined at the outer-most edge of the associated outer pole piece 26.

This slight outward offset enables the biasing force established due to the normal compression state of the O-ring 72 to force the outer end 32 of each armature 28 downwardly, thereby tending to rotate the upper end 30 about the respective outer pole pieces 26 and thus biasing each armature inner end 30 into engagement with the shock absorbing member 36, which is preferably another O-ring. Such simultaneous biasing of the armatures' outer ends is desirable since it defines substantially the same spacing between each armature 28 and its associated inner pole piece 26, thereby enabling the same degree of attracting force to pull each armature down upon energization of the associated acuator. Further, since the armatures' inner ends 30 are all biased against a common reference surface defined by the O-ring 36, the actuated styli 14 each will hit a record medium at substantially the same instant of time.

The biasing force applied to the armatures' outer ends 32 also serves to normally hold each armature in engagement with its associated outer pole piece 26 in order to insure that the proper magnetic flux path is established upon energization of the actuator.

Figure 4:
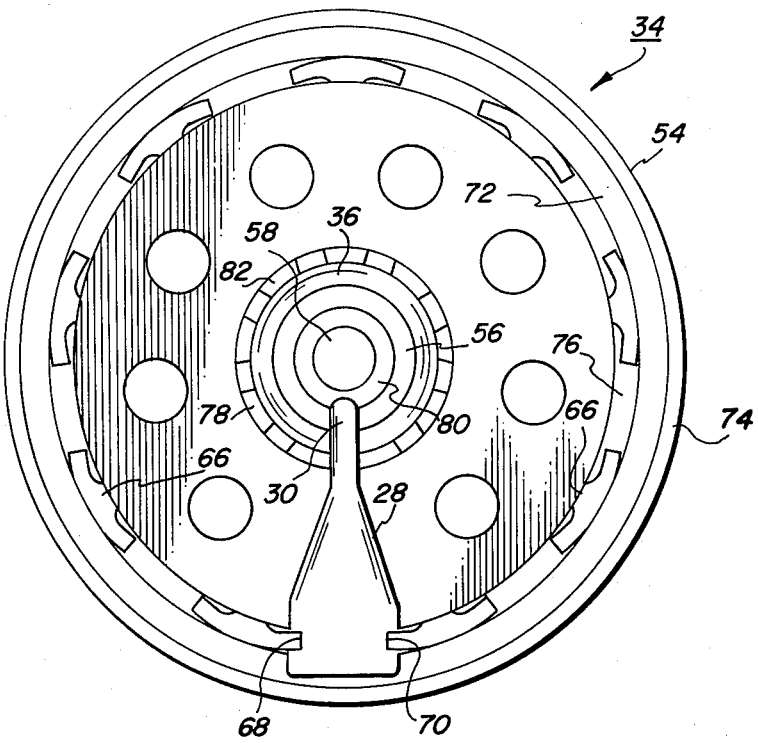
FIG. 4 is a bottom plan view of the armature retainer shown in FIGS. 1 and 2 with one armature mounted therein.
Figure 5:
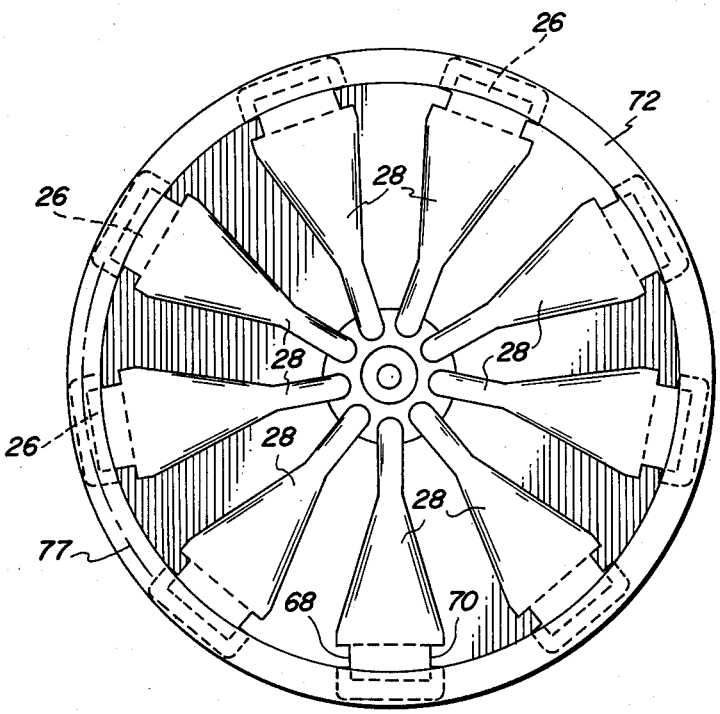
FIG. 5 is a cross-sectional view of the matrix print head of FIGS. 1 and 2 taken along lines 5 — 5 of FIG. 2.
Figure 6:
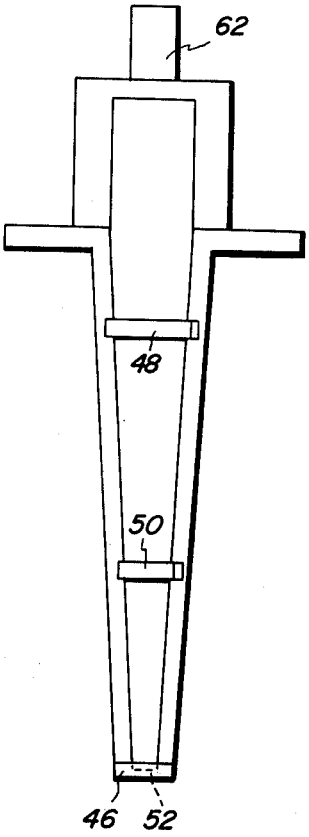
FIG. 6 is a front elevation of the guide assembly shown in FIGS. 1 and 2.
Figure 7:
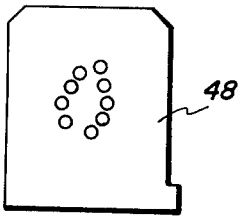
FIG. 7 is a cross-sectional view of the matrix print head of FIGS. 1 and 2 taken along lines 7 — 7 of FIG. 2.
Figure 8:
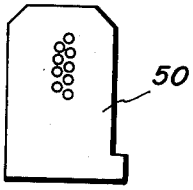
FIG. 8 is a cross-sectional view of the matrix print head of FIGS. 1 and 2 taken along lines 8 — 8 of FIG. 2.
Figure 9:
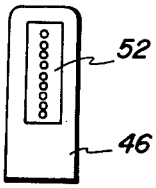
FIG. 9 is a cross-sectional view of the matrix print head of FIGS. 1 and 2 taken along lines 9 — 9 of FIG. 2.

As best shown in FIGS. 2 and 4, the O-ring 36 is mounted to the retainer between a pair of walls 78 and 80 depending from the central portion 56 of the disk 54. The wall 78 has a plurality (e.g. nine) spaced grooves 82 formed therein for respectively accomodating the armatures 28 at locations adjacent the inner ends thereof. The grooves 82, in cooperation with the posts 66 and notches 68 and 70 in each armature 28, suitably restrain any movements of the armatures in a plane perpendicular to the longitudinal axis 84 of the head 10. The O-rings 72 and 36, in cooperation with the outer pole pieces 26, cooperate to restrain any movements of the armatures in other directions.

The primary function of the O-ring 36 is to serve as a shock absorber to dampen the rebound force of each stylus following impact on a record medium and de-energization of the associated actuator. Additionally, and as pointed out above, the O-ring 36 defines a reference surface for the styli during de-energized periods of the actuators. The O-ring 72, aside from the multi-purpose uses as above-described, also serves to prevent any significant rebound of an armatue 28 off the O-ring 36 following de-energization of the actuator ad retraction of the armature. Any tendency of an armature to pivot downwardly again followng de-energization and impact of its inner end 30 against the O-ring 36 will be dampened and counter-balanced by the biasing force exerted by the O-ring 72, which biasing force will, of course, increase as the O-ring 72 is further compressed.

In operation, a character desired to be imprinted is formed by selective energization of the nine actuators for each column of a predetermined number (e.g. seven) of columns chosen to define the characters. An actuator selected for energization to propel the associated stylus 14 against an adjacent record medium to form one dot of the desired dot matrix, is energized by applying current through the coil 24. This sets up a magnetic flux path through the actuator causing the armature 28 to be attracted to the inner pole piece 22. As this occurs, the armature inner end 30 forces the cap 38 and thus stylus 14 downwardly causing it to be propelled in free-flight through the guide assembly 12 until its printing end 44 impacts the record medium. The rebound force will cause the return flight of the stylus. The actuator will, in the meantime, have been de-energized by removing current from the coil 24, thereby retracting the armature 28 to the position shown in FIG. 2. When the stylus returns, its cap 38 impacts the armature and is restrained from any significant return rebound due to the damping characteristics of the spring 40. As indicated above, the armature itself will be restrained from any significant return rebound following de-energization of the actuator primarily due to the damping characteristics of the O-ring 72. The shock absorbing characteristics of the O-ring 36 also contributes to the desired damping.

Although the present invention has been described with respect to a presently preferred embodiment, it will be appreciated by those skilled in the art that various modifications, substitutions, etc. can be made without departing from the spirit and scope of the invention as defined in and by the following claims.

What is claimed is:

1. In a matrix print head comprising stylus guide means; a plurality of electromagnetic structures coupled to said guide means, each of said electromagnetic structures including a pole piece; a plurality of armatures disposed radially about said guide means, each of said armatures being associated with one of said electromagnetic structures to form an electromagnetic actuator for transferring electromechanical energy to a stylus, and each of said armatures having an inner end and an outer end projecting outwardly of the associated pole piece; a plurality of styli respectively associated with said plurality of armatures; each of said styli being carried by said guide means and having an armature engaging end for engaging the inner end of the associated armature and a printing end for impacting a record medium when the stylus is propelled through said guide means by energization of the associated electromagnetic actuator; an improved armature retainer coupled to said guide means for maintaining each armature in engagement with its associated pole piece; said armature retainer comprising:

a relatively rigid base member having a central portion connected to said guide means and a peripheral portion including means for receiving each armature at a predetermined location between its inner and outer ends; and a first relatively resilient O-ring mounted to the peripheral portion of said base member for simultaneously emgaging the outer end of each armature in order to simultaneously bias each armature into engagement with its associated pole piece.

2. The armature retainer of claim 1, further comprising a relatively resilient shock absorbing member mounted to the central portion of said base member against which the inner ends of the armatures are held when the associated actuator is de-energized.

3. The armature retainer of claim 1, wherein said relatively rigid base member includes a relatively rigid disc.

4. The armature retainer of claim 1, wherein said O-ring is mounted to said base member with its axial diameter located outwardly of the outer-most edge of each of said pole pieces in order to apply a moment of force to each armature tending to cause each armature to rotate about its associated pole piece toward the central portion of said relatively rigid base member.

5. The armature retainer of claim 2, wherein said relatively resilient shock absorbing member includes a second resilient O-ring.

6. The armature retainer of claim 2, wherein said relatively rigid base member includes a relatively rigid disc, and said relatively resilient shock absorbing member includes a second resilient O-ring.

7. The armature retainer of claim 6, wherein said first resilient O-ring is mounted to said disc with its axial diameter located outwardly of the outer-most edge of each of said pole pieces in order to apply a moment of force to each armature tending to cause each armature to rotate about its associated pole piece toward the central portion of said relatively rigid disc.

* * * * *